United States Patent [19]

Bezek

[11] Patent Number: 4,649,713

[45] Date of Patent: Mar. 17, 1987

[54] MICROWAVE ICE DETECTOR

[76] Inventor: Donald J. Bezek, 1029 Beach Ave., LaGrange Park, Ill. 60525

[21] Appl. No.: 612,644

[22] Filed: May 21, 1984

[51] Int. Cl.[4] ..... F25D 21/02; G01R 27/04

[52] U.S. Cl. ..... 62/140; 62/128; 62/151; 324/58.5 B

[58] Field of Search ..... 62/140, 128, 151, 152; 340/580, 583; 250/341; 324/58.5 B

[56] References Cited

U.S. PATENT DOCUMENTS

| | | | |
|---|---|---|---|
| 3,836,846 | 9/1974 | Overall et al. | 324/58.5 B |
| 3,946,286 | 3/1976 | Kinnunen et al. | 62/151 |
| 4,045,971 | 9/1977 | Brenner, Jr. | 62/140 |
| 4,054,255 | 10/1977 | Magenheim | 324/58.5 B |
| 4,109,481 | 8/1978 | Peek | 62/151 |
| 4,232,528 | 11/1980 | Behr | 62/140 |
| 4,470,123 | 9/1984 | Magenheim et al. | 324/58.5 R |

*Primary Examiner*—Harry Tanner

*Attorney, Agent, or Firm*—Conlon & Kerstein

[57] ABSTRACT

A sensing and control device is provided for monitoring the build up of frost, ice and condensate on the cooling coils of refrigeration unit. The microwave unit is placed a fixed distance away from a cooling coil and provides an emitted wave and reflected wave. The reflected wave, and the resulting standing wave, shift in spacial phase which differs due to the accumulation of ice or frost and provides a voltage change which is observed by an electronic circuit to shut off the cooling unit while activating a defrost cycle or merely keeping the refrigeration shut off until the ice melts. The sensing and control unit is also used to sense the removal of ice and frost by heating of the defrost cycle and thus establish the termination of defrost cycle and restoration of refrigeration. The microwave sensing device permits the refrigeration unit to be cycled on and off to prevent an excessive build-up of ice which would dramatically lower unit efficiency by preventing the circulation of cooling air across the heat exchanger or coil as it is called to circulate cool air into the contiguous space.

10 Claims, 7 Drawing Figures

MICROWAVE ICE DETECTOR

BACKGROUND OF THE INVENTION (1.) Field of the Invention

This invention pertains to a microwave sensing device used with refrigeration units to monitor the build up of frost and ice on the evaporator coils and to trigger control equipment to cycle the refrigeration unit on and off before an undesirable accumulation of ice occurs which lowers unit efficiency and requires that the refrigeration unit be shut down for an extended period of time.

(2) Description of the Prior Art

Prior art refrigeration defrosting units generally involve use of a heater to remove frost and ice from evaporator (cooling) coils. In a domestic refrigerator, which is self defrosting, the refrigeration coils are located adjacent to an electric heater which operates on a timer and turns on periodically to allow ice which accumulates on the cooling coils to defrost. Somewhat similarly, large industrial refrigeration units also include a heating, defrost cycle but unlike the domestic refrigerator units, generally provide control valves which evacuate refrigerant from the cooling coils and add a heating fluid directly into the cooling coils to melt ice on the surface of the coils. Both the home refrigerator automatic defrost cycle and the industrial defrost arrangements are cycled to turn on periodically without specific determination of the amount of frost and ice built up on the cooling (evaporator) coils. In extremely humid weather, excessive ice can build up and render the unit virtually inoperative because the ice build up restricts the flow of air across the cooling coils. When the circulating air is blocked, the cooling effect of the refrigeration unit is lost, unit efficiency plummets, and the cost of cooling rises dramatically. The energy efficiency ratio (EER, which is the ratio of energy provided to the system compared with the cooling effect produced) decreases dramatically. During other times of the year, when the humidity is relatively low, defrosting is not required on such a frequent basis. Conventional automatic defrost cycles do not monitor frost and ice build up. Such systems are only time dependent and use a fixed (adjustable) defrosting cycle without regard for the presence or absence of ice on the cooling coils.

One type of ice detection apparatus utilizing microwaves is shown in the Overall, U.S. Pat. No. 3,836,846 (1974). The microwave detection apparatus shown in this patent is directed to measuring the build up of ice, water and the like on the surface of a roadway and utilizes a window on the surface of the roadway through which microwaves pass. If no water or ice is present virtually no microwaves are reflected. When a certain amount of ice or water is present a substantial amount of microwaves are reflected. The Overall device also contemplates using a heater element to assist the device and to distinguish between water and ice. This device has not meet with any acceptance in the refrigeration business because it does not lend itself to measuring ice build up on the surface of the cooling coil and must be used from the inside of the cooling coil which is not practical with refrigeration units.

Another ice detecting system utilizing microwaves is shown in the Magenheim U.S. Pat. No. 4,054,255 (1977). The ice detector shown in this patent relates to a system used to detect undersirable ice build up on an aircraft wing or rotor of a helicopter. The system utilizes the metallic surface of the wing to transmit microwave energy by coupling it through and along the metal surface and therefor through any surface ice. The presence of ice changes the phase characteristic of the microwave energy as it is reflected back to the receiver. The ice on the surface of the transmitting airfoil affects propagation of the microwave over the wing surface. It is this disturbance of the microwave that is then read by the microwave source to indicate to the operater the build up of ice on the airfoil or rotor. Unlike the disclosure herein, the Megenheim ice detector uses the metal surface upon which the ice collects to transmit microwaves and utilizes the ice on the exterior of the metal surface to affect propagation of the microwave energy. Magenheim does not disclose attachment of the microwave source and electronic sensor at a location spaced above the surface on which the ice accumulates as done in the instant invention. Installation of such a microwave detector in a refrigeration system would require extensive modification to the system in order to use the refrigerating coil as a microwave transmitter instead of a microwave reflector as is done herein. The overall arrangements is also not practical in a refrigeration unit because of the extensive modification which would be required to install a surface waveguide coupler to a cooling coil in order to transmit microwaves over the surface of the metal of the cooling coil. The fins normally present on cooling coils would block propagation of microwave energy along the surface of the coil.

The above problems are overcome by the instant invention which may be easily attached to a coil of a refrigeration unit and at location where frost build up is likely to occur.

SUMMARY

Microwaves occupy a region in the electromagnetic spectrum which is bounded by radio waves on the side of longer wavelengths and by infrared waves on the side of shorter (optical) wavelengths. Microwaves have several well known applications in communications, radar and more recently cooking. In communications, a great advantage of microwaves lies in the immense quantity of available frequencies. For example the frequency difference between the so-called S band (wavelength around 10 cm) and K band (wavelength around 1 cm) is roughly 20.000 Mhz. This frequency space is roughly 100 times the combined frequency range of present day radio broadcasting, television, and communication. Microwaves have other advantages of being capable of being transmitted and received by physically smaller size antennas. Microwaves, being of a very high frequency, also have the ability to differentiate one reflecting object from another more distinctly than the longer frequency radio waves. Infrared rays, although having a shorter wavelength and useful in many proven applications, are not subject to the ease of manipulation and control and are generally inferior with regard to power concentration at a given frequency and range of propagation in the atmosphere.

Currently the Federal Communications Commission (FCC) has assigned several frequencies for industrial and commercial use. Two microwave industrial frequencies are 10.525 GHz and 24.150 GHz.

The device disclosed herein could operate satisfactorily at any frequency from 0.1 GHz to 300 GHz (or even higher). Practical constraints, such as FCC allocations and cost of frequency generator sources, necessitate a choice at this time in the traditional "microwave" band ( 3 to 30 GHz).

This disclosure pertains to a frost detecting device utilizing a microwave generator which emits a microwave signal and a microwave receiver which receives a reflected signal for comparsion with the emitted signal. The difference between the emitted and reflected microwave signal patterns produces a small voltage which is measured and compared electronically. When a predetermined amount of frost is present on a cooling coil of refrigeration system, the microwave device senses the change in the difference of the emitted and reflected microwave signals and triggers a defrosting system which allows the ice and frost to melt.

The frost detecting and control unit utilizing the microwave emitter and receiver can easily be attached to the cooling coil in refrigeration system. Large, industrial refrigeration systems have so-called chiller units (technically called an evaporator) which use copper or steel pipes with or without thin, aluminum fins attached for the circulation of refrigerant such as freon or ammonia. By simply removing several of the fins and attaching the bracket which holds the microwave unit the frost detector can be added to a system. Once the microwave unit is attached, it may easily be wired into the defrost control system of the refrigerating unit. A bracket is provided which postions the waveguide of the microwave sensor unit a predetermined, fixed distance away from the refrigerant pipe. This predetermined distance is held constant and thus provides maximum utilization of the unit in sensing frost build up on the cooling coil. It is not mandatory that the mounting bracket be utilized to mount the microwave unit at a specific location above, below or at the side of the cooling coil. It is also contemplated that the frost sensing unit could be mounted at the end of a cooling coil plenum or at a position about a opening in a cooling coil frame which would not require removal of cooling fins from the refrigerating coil. The fixed distance between the cooling coil surface and the waveguide should be maintained.

In operation, a solid state, microwave source, a diode detector and a waveguide are provided to generate and conduct the microwave energy. As microwave energy is transmitted down the waveguide and emitted through a radiating aperture, they strike the adjacent cooling coil pipe. Part of the microwave energy is reflected back into the waveguide and interfers with the emitted microwave pattern to produce a standing wave pattern. The reflected wave will be somewhat out of phase synchronization with the emitted wave, depending on the amount of ice or frost on the cooling coil. This socalled phase delay, which is due to the ice or frost, shifts the standing wave pattern in the waveguide resulting in a change in the microwave energy (power) output which therefore changes. This voltage change causes a response in associated electronic control circuitry which actuates a control relay to operate the defrost cycle. Conversely, the removal of frost by the defrosting heat is also deleted by the microwave sensor to determine when the defrost cycle should be terminated and the cooling equipment reactivated. The voltage at the diode dectector is located electronically at the maximum slope point of the standing wave pattern to easily sense maxumum shift in the wave which is produced by frost build up.

It has been found that spacing the wavguide approximately three tenths (3/10) of a inch away from the cooling coil surface and utilizing a frequency of 24.150 GHz produces the most sensitivity for reading frost build up and triggering the defrost control equipment.

It is thus an object of this disclosure to provide a frost detecting and defrost device for controlling the build up of frost and ice in a refrigerating unit by utilizing a microwave generator.

Another object of this disclosure is to provide a microwave generator which is portable and can easily be attached to the cooling coil in a refigeration system by utilizing a mounting bracket which positions the critical end point of the microwave waveguide at a fixed, predetermined distance away from the surface of the coil or open pipe upon which ice and frost accumlate.

Another object of this disclosure is provide a microwave sensing device to monitor the build up of ice and frost on a surface of a cooling coil whereby the microwave device is coupled with the cooling control system which automatically melts undersirable frost and ice when a predetermined build up of frost and ice occurs.

Another object of this disclosure is to disclose an ice and frost detector utilizing microwave energy which is emitted through an aperture of a waveguide and reflected back into the waveguide and produces a standing wave shift and voltage which is sensed by an electronic circuit to trigger defrost equipment.

Another object of this disclosure is to disclose a microwave detector for use in monitoring the build up of frost and ice on a cooling coil and utilizing a mounting bracket which attaches directly to the coil and places the end of the waveguide at a predetermined, fixed distance from the cooling coil.

Another object of this disclosure is to show a microwave ice detector which can be mounted adjacent a cooling coil by attaching it to a part of the refrigerating unit adjacent the coil.

These and objects of the disclosure will become apparent to these having ordinary skill in the art with reference to the following description, drawings and claims.

DESCRIPTION OF THE PERFERRED EMBODIMENT

The following description is related to the frost detector being installed in an industrial refrigeration or freezing unit; however, the invention is not to be restricted thereto and could be easily adapted to home refrigerator/freezers and other cooling units such as automotive, home and truck air conditioners, highway and rail car freezing units or any piece of equipment where frost build up occurs on an evaporator.

Figure 7:
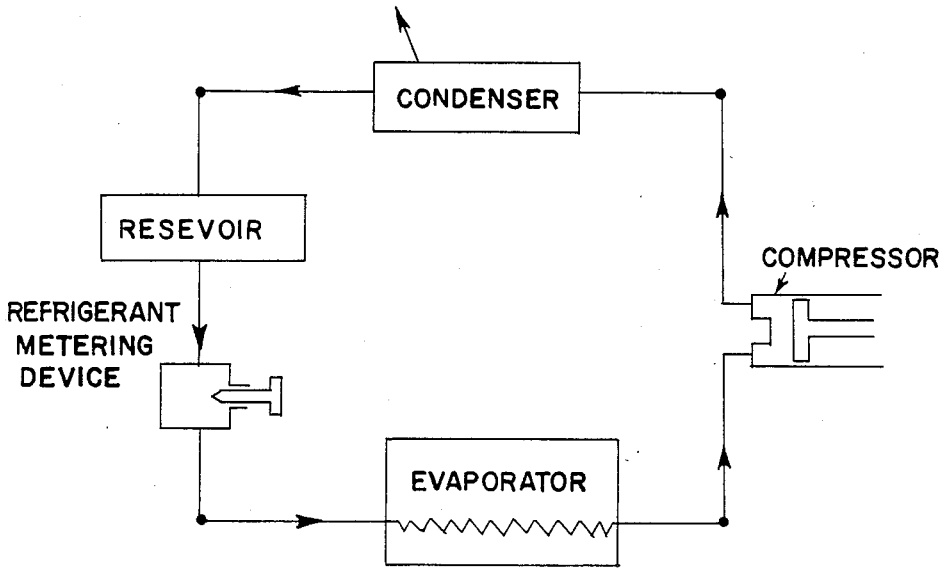
FIG. 7 is a schematic illustration of a typical refrigeration system.

FIG. 7 shows a typical refrigeration/freezing system. It should be pointed out that any cooling refrigeration or freezer utilizes basically the same system. The only differences are perhaps the refrigerant utilized or pressures and pressured drops which are involved. In an typical refrigeration system a compressor compresses a refrigerant and passes the compressed refrigerant gas into the condenser portion in which the gas is cooled and forms a liquid. In a home refrigerator, the compresser is the motorized unit generally at the bottom of the refrigerator and the condenser is the formed tube member generally at the back or bottom of the refrigerator. As fluid passes from the condenser it may or may not enter a reservoir where it is collected before being forced through a refrigerant metering device. As the cooled fluid passes through the metering device it expands rapidly and changes state from a liquid to an extremely cold gas. This metering/cooling process is a natural phenomenon and is generally experienced by most people for example in using a propane torch. As the liquid propane leaves the pressurize cyclinder in which it is stored, it produces a cooling effect at the control valve which sometimes collects frost. This rapid expansion of the liquid to a gas state produces the cold gas which is passed to the cooling coils of the evaporator where the gas absorbs heat from material, such as stored products nearby, causing the stored products then to be chilled or frozen as desired. The evaporator is a heat exchanger. As the very cold gas removes heat from the adjacent area and loses the cooling effect, it is drawn into the compressor where it is once again compressed and recycled through the refrigeration system.

One of the chief purposes in any refrigeration system is to receive the maximum cooling effect from the cold gas passing through the coils of the evaporator. However, when these coils become covered with frost and ice the cooling effect is reduced because the ice and frost not only block cold air from passing over the coils but also served to insulate the coils to prevent the cold pipes from absorbing heat from the area and providing a proper cooling effect. As mentioned earlier, the rate of build up of frost and ice on cooling coils cannot be predicted with great accuracy because it depends on the number of times the refrigeration unit is called upon to cool adjacent area and also upon the humidity or amount of mositure in the air passing over the coils. Because cooling load and humidity are important factors which cannot be controlled, using timers to automatically shut down the refrigeration unit after so many hours of operation is not efficient because it is conceivable they will over defrost or under defrost if not reset frequently to compensate for changes in duty cycle and ambient humidity.

The microwave frost detector disclosed hereafter is attached on one of the coils of the evaporator in typical system show in FIG. 7. In a home refrigeration unit or in a window air conditioner or a automobile conditioner or the like the microwave sensor unit would be set up at a convenient location on the evaporator and function in the same way as disclosed in the perferred embodiment relating to an industrial application.

Figure 1:
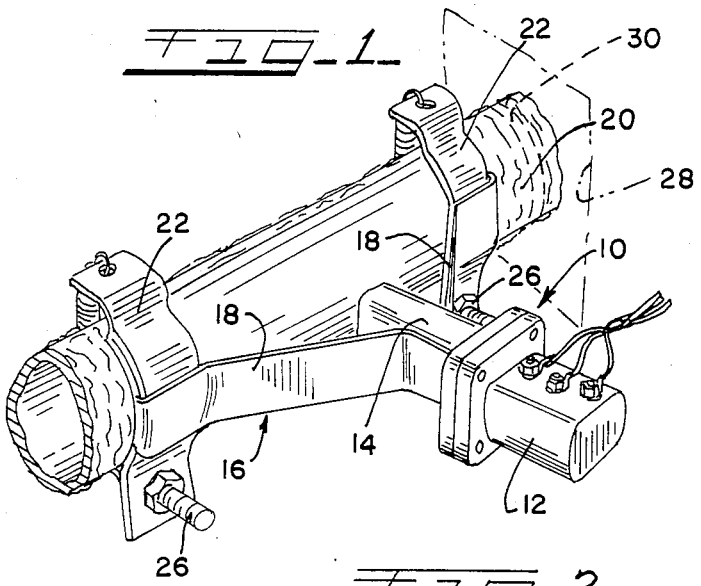
FIG. 1 is pictorial illustration showing the microwave device attached to a cooling coil of a refrigeration system.

As shown in FIG. 1 the microwave frost detector is designated by the numeral 10 and shows a wave oscillator detector section 12 connected with a waveguide 14. It should be understood the microwave energy consists of very high frequency electro magnetic field waves which are generated by a so-called oscillator which is the source of microwave energy. In this particular instance a so-called Gunn oscillator is utilized to emit microwave energy at a frequency of 24.150 Giga Hertz (GHz). The theory of operation of a microwave sensing device such as the one shown here is that microwave energy is emitted at a certain fixed rate (amplitude and frequency) and reflected back at the same rate and in a certian spatial phase from a solid metal surface such as a cooling coil. However, when frost or ice accumlates on the surface of the coil, the reflected microwaves are reflected back in a different phase than in the instance where frost is not present. The difference between the emitted wave pattern and the reflected wave pattern is called a phase shift which is monitored by electronic apparatus. This phase delay or shift of the reflected microwave results in a certain power incident on the detector diode and a resultant voltage generated by the detector diode. When a predetermined voltage change is detected which corresponds with a predetermine amount of ice or frost build up on the cooling coil, the microwave sensor triggers a defrost cycle which permits the cooling coil to warm, resulting in a melt down of the ice or frost. It has been found that positioning the end of waveguide 14 approixmetly 0.310 inches away from the surface of the cooling coil and utilizing a frequency of 24.150 GHz, that frost buildup in the range of 1/16 inches to ⅛ inches can easily be detected. The defrost cycle must begin with this amount of ice build up because any larger build up prevents air circulation through the coil causing even more ice to form. As more ice forms, the ice acts as an insulator surrounding the coil, further compounding the problem by maintaining the coil at a very low temperature with no resultant cooling of the adjacent space. This ice build up dramatically reduces the efficiency of the unit and increases operating costs.

A bracket 16 is utilized to mount the oscillator/detector 12 and waveguide 14 adjacent coil 20. Bracket 16 has arms 18 extending outwardly therefrom and includes a strap portion 22 which permits the bracket to be attached to the coil 20. As shown in FIG. 1, the bracket also includes springs 24 which extend about the backside of the coil 20 and are contected with the strap 22. A tensioning screw 26 permits the spring to be extended and grip the coil 20. Thin fins 28 having attaching collars 30 which improve heat transfer from coil 20, are shown in their normal configuration attached to the coil 20. As shown in FIG. 1, it is necessary to remove a number of fins 28 to permit the unit to be attached directly to the coil 20.

Figure 2:
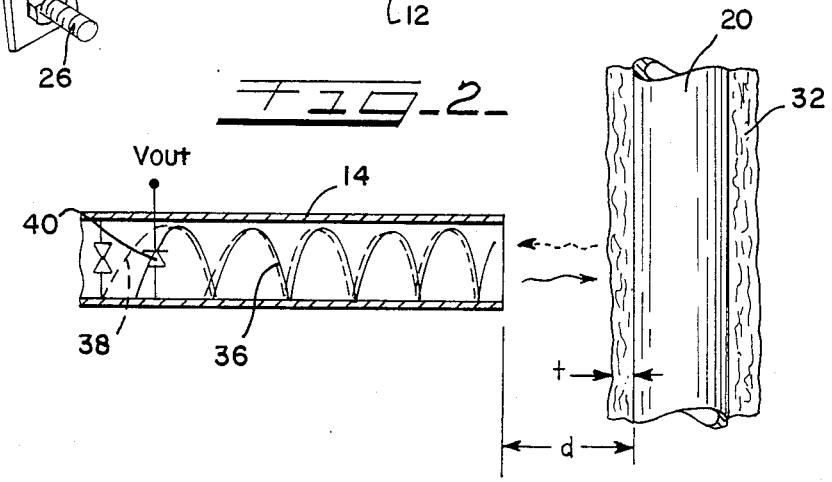
FIG. 2 is a schematic illustration of the waveguide and associated cooling coil showing the standing wave and phase shift associated with a frost buildup.
Figure 3:
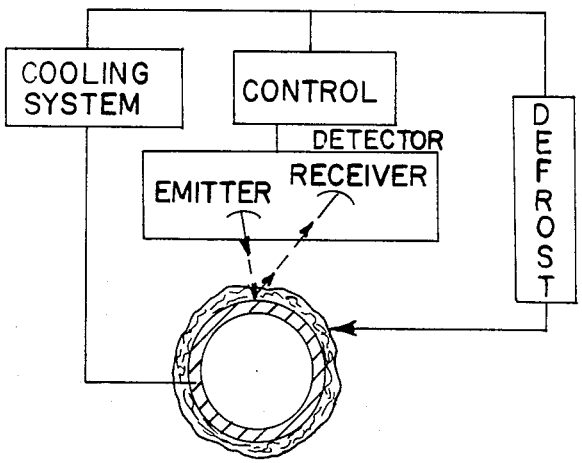
FIG. 3 is a schematic illustration of the control equipment utilized with the microwave generator.

FIG. 2 shows the arrangement of waveguide 14 at a point 0.310 inches away from the surface of the coil 20. Frost having a thickness indicted by the letter t and by the numeral 32 begins to accumulate on the coil 20. The microwave generator or Gunn Oscillator as it is called emits a wave which is reflected back at the same frequency from the surface of a coil 20. The standing wave (or interference) pattern of the outgoing and reflected electromagnetic field wave patterns is indicated by numeral 36. When ice and frost begin to form, the reflected wave is shifted in spatial phase with the emitted wave is shown by the dotted lines 38. This phase shift will cause a change in voltage produced by the detector diode because the incident power on the diode is changed. Diode 40 is connected to control circuitry that is preset to detect certain level of voltage and cause the cooling system to shut down and a defrost system to begin operation. In some systems the cooling system merely shuts down to allow electric heaters to defrost the ice. In larger industrial systems when the cooling system shuts down the refrigerent is purged from the coils 20 and a heated gas is circulated through the coils or electric resistance heaters are turned on to produce rapid melting of the frost or ice. When the frost is melted the phase of the reflected wave reverts to its original pattern and the diode voltage also reverts to its original level. This reversing of the detected voltage is used by the control circuitry to terminate the defrost cycle and restart the refrigeration cycle, thus the defrost time is no longer than required to clear the coil of ice or frost.

Figure 4:
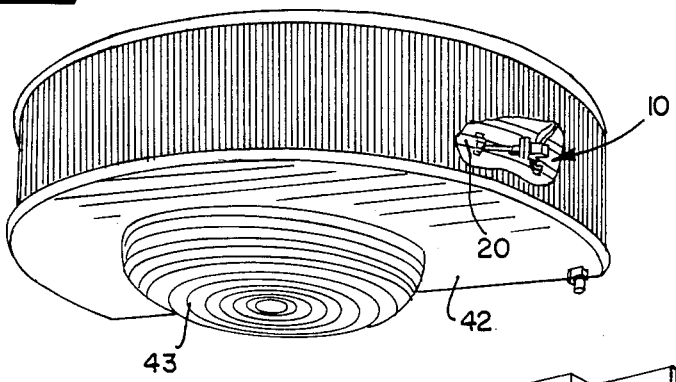
FIG. 4 is a pictorial illustration of one type of a cooling or chiller unit in a refrigeration system showing the automatic defrost device attached thereto.
Figure 5:
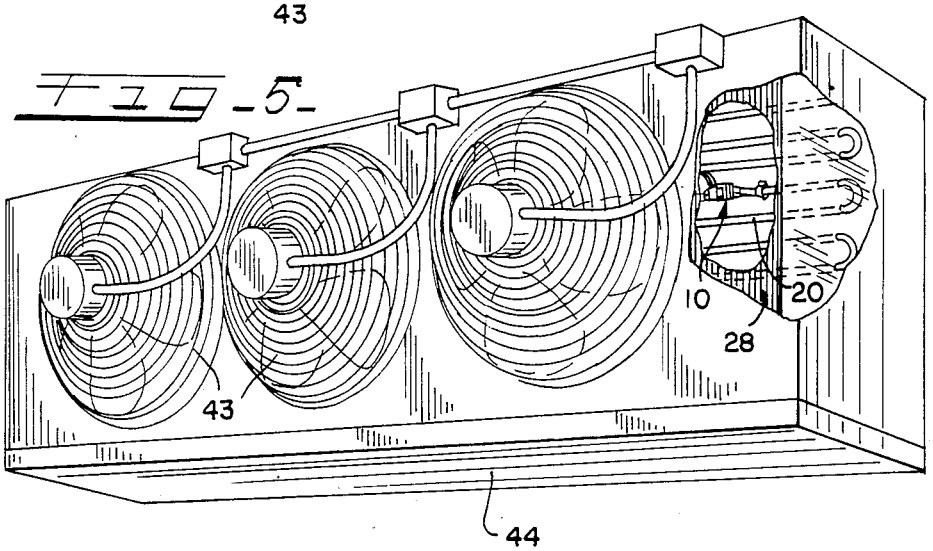
FIG. 5 is another form of large capacity commerical cooling unit showing the microwave frost detector.
Figure 6:
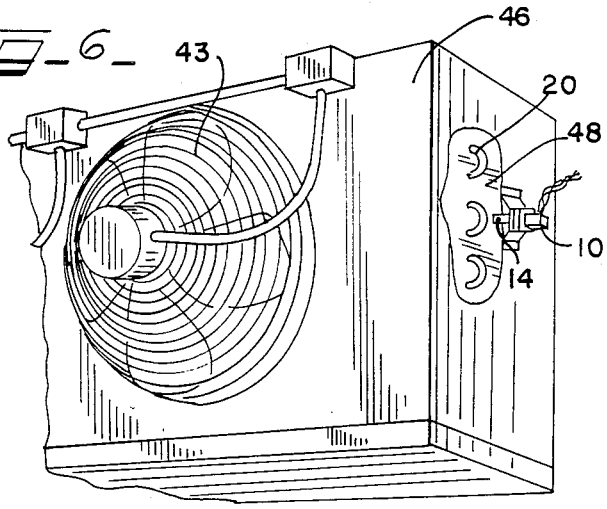
FIG. 6 shows the microwave frost detector attached to a housing with waveguide protruding through an aperature in the housing.

Use of the microwave frost detector 10 can be adapted to a varied of industrial chiller units. FIG. 4 shows the frost detector 10 attached to the coils of a semi-circular unit. In this application it would be attached in the same way by removing a number of Fins from the coil and attaching the mounting bracket directly to the coil. Another arrangement is shown in FIG. 5 where the frost detector 10 has been attached to a cooling coil having fins removed. Another application is shown in FIG. 6 where cooling unit is not attached directly to the coils as might be required where the coils would be difficult to gain access to and where it would be more desirable to merely make an opening in the end of the housing of the unit 46 and attaching the frost detector 10 and that fashion.

Thus it is shown by the forgoing that the microwave detector unit can be easily attached to refrigeration systems and provides a reliable and easily attached device for sensing the frost build up on the coil of a refrigeration unit thus perventing excessive build up which reduces the efficiency of the unit.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

I claim:

1. A sensing device to monitor the presence and amount of matter such as condensate, frost and ice on the surface of a heat exchange portion of a cooling unit and to control the cooling unit to shut it off when an predetermined amount of matter is present on the heat exchanger by lowering its efficency and ability to absorb heat and thereby cool air passing across the heat exchanger, the improvement comprising:

a microwave generator:

said microwave generator including a waveguide in proximity with said surface of the heat exchanger and spaced outwardly therefrom at a point to monitor the presence and absence of matter on said surface of the heat exchanger;

said microwave generator including both a source for emitting microwave energy (microwaves) through said waveguide to strike and be reflected from said heat exchanger, and, also including a receiver for monitoring microwave energy (also microwaves) reflected from the heat exchanger whereby the accumulation of matter on the monitored part of the heat exchanger produces a phase shift between the emitted and reflected microwaves resulting on a voltage which is monitored;

electrical connector means coupling the microwave generator with the cooling unit;

electrical comparison means for comparing the voltage produced by the emitted and reflected microwave energy when matter is present on the heat exchanger;

electrical triggering means having means coupled with the electrical comparison means including control means for causing the cooling unit to shut off at a predetermined level as determined by the comparison means in measuring and comparing the emitted waves and reflected waves to eliminate undesirable frost and ice, and, thereafter turn on the cooling unit when the frost and ice has been reduced to an acceptable level as determined by the sensing device.

2. The sensing device of claim 1, and, said microwave generator further including:

control means for adjusting the triggering means and having means coupled to the cooling unit whereby the cooling unit may be cycled on for operation and off for defrost at various points depending upon the predetermined desirable amount of matter allowable on the heat exchanger.

3. The sensing device of claim 1 and:

said heat exchanger having cooling coils;

means mounting said sensing device to place said waveguide in proximity with an adjacent cooling coil.

4. The sensing device of claim 1, and said sensing device further including:

said emitted and reflected microwave energy producing a standing wave;

monitoring means for measuring the voltage difference between the emitted microwave energy and the standing wave.

5. The sensing device of claim 1, and said microwave generator comprising:

a microwave source emitting microwave energy at a frequency of 24.150 GHz.

6. The sensing device of claim 1, and:

said microwave generator having said waveguide located in the range of three tenths of an inch from said heat exchanger to produce a maximum voltage when matter accumulates on said heat exchanger and said phase shift occurs between emitted and reflected microwave energy.

7. The sensing device of claim 1, and:

said heat exchanger having a plurality of coils for the circulation of cooling fluid;

bracket means attached to said sensing device and having strap means attaching to one of said coils for securely mounting the sensing device and for accurately positioning said waveguide at a fixed and constant distance from said coil.

8. The sensing device of claim 7 and said bracket including:

spring members connected with the strap members and encircling a portion of said coil;

adjustment means connected to said spring and said strap members for adjusting the amount of holding force for securing the bracket to the coil.

9. A method of monitoring, detecting and controlling the presence of matter such as frost and ice in a cooling system on a heat exchanger to thereby control and eliminate the excessive build up of frost and ice, the method of improvement further including the following steps:

providing a microwave detector;

electrically connecting the detector to the refrigeration system;

attaching the detector adjacent the heat exchanger at a point where ice, frost and other condensate accumulate;

presetting the detector to trigger the cooling system and turn if off when a predetermined, objectionable level of accumulated matter is present on said heat exchanger;

emitting microwave energy from said detector to strike an adjacent part of the heat exchanger and thereby produce reflected microwave energy;

measuring the emitted and reflected microwave energy;

comparing the emitted and reflected microwave energy;

determining if the comparison of emitted and reflected waves indicate an objectionable level of matter such as ice and frost is present on said heat exchanger;

deactivating the refrigeration system to allow the excessive build up to melt;

monitoring the build up of matter as it melts., reactivating the refrigeration system when the build up of matter on the heat exchanger has been reduced to an acceptable level.

10. The method of claim 9, and further including the steps of:

providing electronic means which produce a voltage when the emitted microwave energy and the reflected microwave energy differ;

measuring said voltage to determine of a predetermined voltage has been reached which will signal an undesirable build up of matter such as frost and ice.

* * * * *